US007826623B2

(12) United States Patent
Christoph

(10) Patent No.: US 7,826,623 B2
(45) Date of Patent: Nov. 2, 2010

(54) HANDSFREE SYSTEM FOR USE IN A VEHICLE

(75) Inventor: Markus Christoph, Stauhing (DE)

(73) Assignee: Nuance Communications, Inc., Burlington, MA (US)

( * ) Notice: Subject to any disclaimer, the term of this patent is extended or adjusted under 35 U.S.C. 154(b) by 751 days.

(21) Appl. No.: 10/563,072

(22) PCT Filed: Jun. 30, 2004

(86) PCT No.: PCT/EP2004/007110

§ 371 (c)(1),
(2), (4) Date: Aug. 23, 2006

(87) PCT Pub. No.: WO2005/004532

PCT Pub. Date: Jan. 13, 2005

(65) Prior Publication Data

US 2007/0127736 A1 Jun. 7, 2007

(30) Foreign Application Priority Data

Jun. 30, 2003 (EP) ..... 03014846

(51) Int. Cl.
*H04R 3/00* (2006.01)

(52) U.S. Cl. ..... 381/92; 367/118; 367/119; 381/122

(58) Field of Classification Search ..... 381/91–92, 381/122, 94.1–94.3, 86; 367/12, 118–119
See application file for complete search history.

(56) References Cited

U.S. PATENT DOCUMENTS

| | | | | |
|---|---|---|---|---|
| 4,696,043 | A * | 9/1987 | Iwahara et al. | 381/92 |
| 5,659,619 | A * | 8/1997 | Abel | 381/17 |
| 5,715,319 | A | 2/1998 | Chu | |
| 6,339,758 | B1 * | 1/2002 | Kanazawa et al. | 704/226 |
| 6,507,659 | B1 * | 1/2003 | Iredale et al. | 381/26 |
| 6,549,627 | B1 | 4/2003 | Rasmusson et al. | |
| 6,594,367 | B1 * | 7/2003 | Marash et al. | 381/92 |
| 6,748,088 | B1 * | 6/2004 | Schaaf | 381/92 |
| 6,836,243 | B2 * | 12/2004 | Kajala et al. | 342/377 |
| 7,076,072 | B2 * | 7/2006 | Feng et al. | 381/313 |
| 7,158,643 | B2 * | 1/2007 | Lavoie et al. | 381/58 |
| 2003/0063759 | A1 * | 4/2003 | Brennan et al. | 381/92 |
| 2003/0072464 | A1 * | 4/2003 | Kates | 381/312 |
| 2004/0120532 | A1 * | 6/2004 | Dedieu et al. | 381/92 |

FOREIGN PATENT DOCUMENTS

WO WO 01/87011 A2 11/2001

OTHER PUBLICATIONS

Su, et al., "Performance Analysis of MVDR Algorithm in the Presence of Amplitude and Phase Errors", IEEE 2001.

* cited by examiner

*Primary Examiner*—Devona E. Faulk
*Assistant Examiner*—Disler Paul
(74) *Attorney, Agent, or Firm*—Sunstein Kann Murphy & Timbers LLP

(57) ABSTRACT

The invention is directed to a handsfree system for use in a vehicle comprising a microphone array with at least two microphones and a signal processing means wherein the signal processing means comprises the superdirective beamformer with fixed superdirective filters.

26 Claims, 11 Drawing Sheets

HANDSFREE SYSTEM FOR USE IN A VEHICLE

This application claims the benefit of priority from European Application No. 03014846.4, filed Jun. 30, 2003 and PCT Application No. PCT/EP2004/007110, filed Jun. 30, 2004, both of which are incorporated by reference.

The invention is directed to a handsfree system for use in a vehicle comprising a microphone array with at least two microphones and a signal processing means.

In WO 00/30264, a method of processing signals received from an array of sensors is disclosed, the processing including filtering the signals using a first and a second adaptive filter.

A system for discerning an audible command from ambient noise in a vehicular cabin is known from US 2002/0031234. The prior art system disclosed in this document includes a microphone array. Each of the microphones is coupled to a delay and weighting circuitry. The outputs of this circuitry are fed to a signal processor either directly or after being summed. According to the teaching of this document, the signal processor performs delay and sum processing, Griffiths-Jim processing, Frost processing, adaptive beamforming and/or adaptive noise reduction.

In other words, the signal processing functions mentioned in both prior art documents—except for the delay and sum processing—are adaptive methods. This means that the processing parameters such as the filter coefficients, are permanently adapted during operation of the system. Adaptive processing methods are costly to implement and require a large amount of memory and computing power. The delay and sum processing, on the other hand, shows a bad directional characteristic, in particular, for low frequencies.

Therefore, it is the problem underlying the invention to overcome the above-mentioned problems and to provide a handsfree system for use in a vehicle having good acoustic properties, in particular, a good Signal-To-Noise-Ratio (SNR), a directional characteristic and is not too costly to implement.

This problem is solved by the handsfree system according to claim 1. Accordingly, the invention provides a handsfree system for use in a vehicle comprising a microphone array with at least two microphones and a signal processing means wherein the signal processing means comprises a superdirective beamformer with fixed superdirective filters.

Suprisingly, such a handsfree system shows an excellent acoustic performance in a vehicular environment. In particular, speech signals are enhanced and ambient noise is reduced. Furthermore, due to the non-adaptive beamforming with fixed superdirective filters, the computing power during operation is reduced.

According to a preferred embodiment, the beamformer can be a regularized superdirective beamformer using a finite regularization parameter $\mu$. The regularization parameter usually enters the equation for computing the filter coefficients or, alternatively, is inserted into the cross-power spectrum matrix or the coherence matrix. In contrast to the maximum superdirective beamformer ($\mu=0$), the regularized superdirective beamformer has reduced noise and is less sensitive to an imperfect matching of the microphones.

Preferably, the finite regularization parameter $\mu$ can depend on the frequency. This achieves an improved gain of the array compared to a regularized superdirective beamformer with fixed regularization parameter $\mu$.

According to a preferred embodiment, each superdirective filter can result from an iterative design based on a predetermined maximum susceptibility. This allows an optimal adjustment of the microphones particularly with respect to the transfer function and the position of each microphone.

By using a predetermined maximum susceptibility, defective parameters of the microphone array can be taken into account to further improve the gain. The maximum susceptibility can be determined as a function of the error in the transfer characteristic of the microphones, the error in the microphone positions and a predetermined (required) maximum deviation in the directional diagram of the microphone array. The time-invariant impulse response of the filters will be determined iteratively only once; there is no adaption of the filter coefficients during operation.

According to a preferred embodiment, each superdirective filter can be a filter in the time domain. Filtering in the frequency domain is a possible alternative, however, requiring to perform a Fourier transform (FFT) and an inverse Fourier transform (IFFT), thus, increasing the required memory.

According to a preferred embodiment, the signal processing means can further comprise at least one inverse filter for adjusting a microphone transfer function. In this way, conventional microphones can be used for a microphone array by matching the microphones using the inverse filters. Alternatively or additionally, matched microphones on the basis of silicone or paired microphones can be used.

Preferably, each inverse filter is a warped inverse filter.

The susceptibility of microphone arrays increases with decreasing frequency. Due to this, a higher matching precision is necessary for low frequencies compared to high frequencies. A frequency depending adjustment of the microphone transfer functions with the use of warped filters reduces the required memory compared to the case of conventional FIR filters.

Preferably, each inverse filter can be an approximate inverse of a non-minimum phase filter. This results in an inverse filter which is both stable and has no phase error.

According to a preferred embodiment, each inverse filter can be combined with a superdirective filter of the beamformer. Such a coupling of the filters results in a simplified implementation.

According to a preferred embodiment, the beamformer can have the structure of a Generalized Sidelobe Canceller (GSC). In this way, at least one filter can be saved. The implementation in the GSC structure is only possible in the frequency domain.

In order to obtain an optimal adaption of the handsfree system to a particular noise situation, according to a preferred embodiment, the beamformer can be a Minimum Variance Distortionless Response (MVDR) beamformer.

According to a preferred embodiment, at least two microphones are arranged in endfire orientation with respect to a first position. An array in endfire orientation has a better directivity and is less sensitive to a mismatched propagation or transit time compensation. The first position can be the location of the driver's head, for example.

According to a preferred embodiment, the microphone array comprises at least two microphones being arranged in endfire orientation with respect to a second position. Thus, the handsfree system of the invention has a good directivity in two directions. Speech signals coming from two different positions, for example, from the driver and the front seat passenger, can both be recorded in good quality.

Preferably, the at least two microphones in the first endfire orientation (endfire orientation with respect to a first position) and the at least two microphones in the second endfire orientation (endfire orientation with respect to a second position) can have a microphone in common. In this way, already a microphone array consisting of only three microphones can provide an excellent directivity for use in a vehicular environment.

According to a preferred embodiment, the microphone array can comprise at least two subarrays. Each subarray can be optimized for a specific frequency band yielding an improved overall directivity.

To decrease the total number of microphones, preferably, at least two subarrays can have at least one microphone in common.

According to a preferred embodiment, the handsfree system can comprise a frame wherein each microphone of the microphone array is arranged in a predetermined, preferably fixed, position in or on the frame. This ensures that after manufacture of the frame with the microphones, the relative positions of the microphones are known. Such an array can be easily mounted in a vehicular cabin.

According to a preferred embodiment, at least one microphone can be a directional microphone. The use of directional microphones improves the array gain.

Preferably, at least one directional microphone can have a cardioid characteristic. This further improves the array gain. More preferred, the cardioid characteristic is a hypercardioid characteristic.

According to preferred embodiment, at least one directional microphone can be a differential microphone. This results in a microphone array with excellent directivity and small dimensions. In particular, the differential microphone can be a first order differential microphone.

The invention is further directed to a vehicle, in particular, a car, comprising any of the above described handsfree systems.

The invention is also directed to the use of any of the previously described handsfree systems in a vehicle.

Additional features and advantages of the invention will be described with reference to the drawings.

Figure 1:
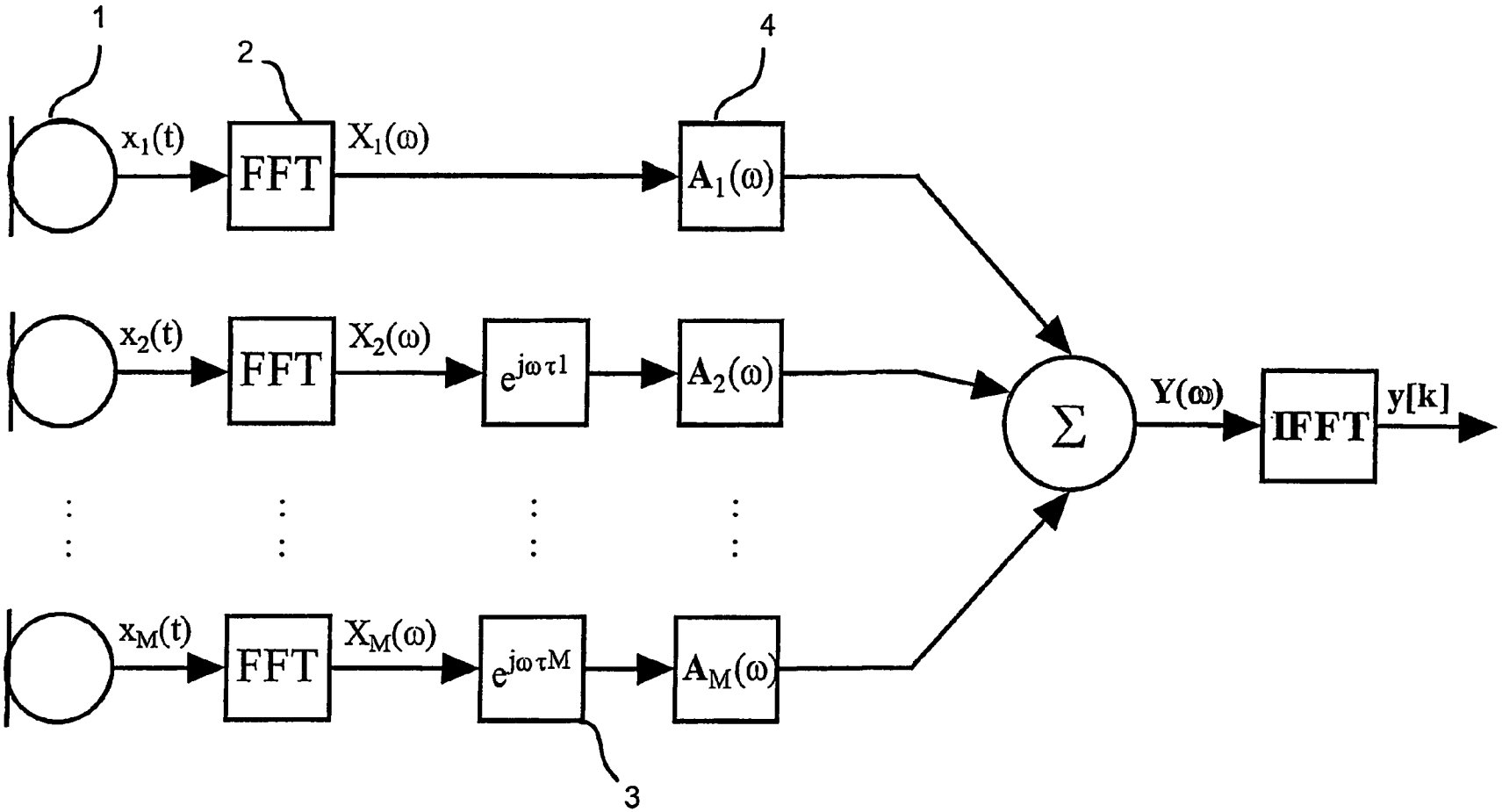
FIG. 1 shows the structure of a beamformer in the frequency domain with four microphones.

The structure of a superdirective beamformer is shown in FIG. 1. The array consists of M microphones 1, each yielding a signal $x_i(t)$. The beamformer shown in this figure performs the filtering in the frequency domain. Therefore, the signals $x_i(t)$ are transferred to the frequency domain by a fast Fourier transform (FFT) 2, resulting in a signal $X_i(\omega)$. In general, the beamforming consists of a beamsteering and a filtering. The beamsteering is responsible for the propagation time compensation. The beamsteering is performed by the steering vector $$d(\omega) = [a_0 e^{-j2\pi f \tau_0}, a_1 e^{-j2\pi f \tau_1}, \ldots, a_{M-1} e^{-j2\pi f \tau_{M-1}}],$$

with $$a_n = \frac{\|q - p_{ref}\|}{\|q - p_n\|}$$

and $$\tau_n = \frac{\|q - p_{ref}\| - \|q - p_n\|}{c},$$

wherein $P_{ref}$ denotes the position of a reference microphone, $p_n$ the position of microphone n, q the position of the source of sound (for example, the speaker), f the frequency and c the velocity of sound. In the far field, one has $$a_0 = a_1 = \ldots = a_{m-1} = 1.$$

According to a rule of thumb, one has the far field situation if the source of the useful signal is more than twice as far from the microphone array as the maximum dimension of the array. In FIG. 1, a far field beamformer is shown since only a phase factor $e^{j\omega\tau_k}$ denoted by reference sign 3 is applied to the signals $X_k(\omega)$.

After the beamsteering, the signals are filtered by the filters 4. The filtered signals are summed yielding a signal $Y(\omega)$. After an inverse fast Fourier transform (IFFT), the resulting signal y[k] are obtained.

The optimal filter coefficients $A_i(\omega)$ can be computed according to $$A_i(\omega) = \frac{\Gamma(\omega)^{-1} d(\omega)}{d(\omega)^H \Gamma(\omega)^{-1} d(\omega)},$$

wherein the superscript H denotes Hermitian transposing and $\Gamma(\omega)$ is the complex coherence matrix $$\Gamma(\omega) = \begin{pmatrix} 1 & \Gamma_{x_1 x_2}(\omega) & \cdots & \Gamma_{x_1 x_M}(\omega) \\ \Gamma_{x_2 x_1} & 1 & \cdots & \Gamma_{x_2 x_M}(\omega) \\ \vdots & \vdots & \ddots & \vdots \\ \Gamma_{x_M x_1}(\omega) & \Gamma_{x_M x_2}(\omega) & \cdots & 1 \end{pmatrix},$$

the entries of which are the coherence functions that are defined as the normalized cross-power spectral density of two signals $$\Gamma_{x_i x_{ji}}(\omega) = \frac{P_{x_i x_j}(\omega)}{\sqrt{P_{x_i x_i}(\omega) P_{x_j x_j}(\omega)}}.$$

Preferably, the beamsteering is separated from the filtering step which reduces the steering vector in the design equation for the filter coefficients $A_i(\omega)$ to the unity vector $$d(\omega) = (1, 1, \ldots, 1)^T.$$

(The superscript T denotes transposing.)

In the case of an isotropic noise field in three dimensions (diffuse noise field), the coherence is given by $$\Gamma_{x_i x_j}(\omega) = si\left(\frac{2\pi f d_{ij}}{c}\right) e^{-j\frac{2\pi f d_{ij}\cos\Theta_0}{c}},$$

with $$si(x) = \frac{\sin x}{x}$$

and wherein $d_{ij}$ denotes the distance between microphones i and j and $\Theta_0$ is the angle of the main receiving direction of the microphone array or the beamformer.

The above described design rule for computing the optimal filter coefficients $A_i(\omega)$ for a homogenous diffuse noise field is based on the assumption that the microphones are perfectly matched, i.e. point-like microphones having exactly the same transfer function. In practice, therefore, a so-called regularized filter design can be used to adjust the filter coefficients. To achieve this, a scalar (the regularization parameter $\mu$) is added at the main diagonal of the cross-correlation matrix. In a slightly modified version, all elements of the coherence matrix not on the main diagonal are divided by $(1+\mu)$:

$$\overline{\Gamma_{x_i x_j}(\omega)} = \frac{\Gamma_{x_i x_j}(\omega)}{1+\mu} = \frac{si\left(\frac{2\pi f d_{ij}}{c}\right)}{1+\mu} e^{-j\frac{2\pi f d_{ij}\cos\Theta_0}{c}}, \forall\, i \neq j.$$

Alternatively, the regularization parameter $\mu$ can be introduced into the equation for computing the filter coefficients:

$$A_i(\omega) = \frac{(\Gamma(\omega) + \mu I)^{-1} d}{d^T (\Gamma(\omega) + \mu I)^{-1} d}$$

wherein I is the unity matrix. For convenience, in the following, the second approach where the regularization parameter is part of the filter equation will be discussed in more detail. It is to be understood, however, that the first approach is equally suitable.

Before discussing the superdirective beamformer in more detail, some characteristic quantities of a microphone array are to be defined. The directional diagram or response pattern $\Psi(\omega,\Theta)$ of a microphone array characterizes the sensitivity of the array as a function of the direction of incidence $\Theta$ for different frequencies.

A measure to describe the directivity of an array is the so-called gain that does not depend on the angle of incidence $\Theta$. The gain is defined as the sensitivity of the array in the main direction of incidence with respect to the sensitivity for omnidirectional incidence.

The Front-To-Back-Ratio (FBR) indicates the sensitivity in front receiving direction compared to the back.

The white noise gain (WNG) describes the ability of the array to suppress uncorrelated noise, for example, the inherent noise of the microphones. The inverse of the white noise gain is the susceptibility $K(\omega)$:

$$K(\omega) = \frac{1}{WNG(\omega)} = \frac{A(\omega)^H A(\omega)}{|A(\omega)^H d(\omega)|}.$$

The susceptibility $K(\omega)$ describes the array's sensitivity to defective parameters. It is often preferred that the susceptibility $K(\omega)$ of the array filters $A_i(\omega)$ does not exceed an upper bound $K_{max}(\omega)$. The selection of this upper bound can be dependent on the relative error $\Delta^2(\omega,\Theta)$ of the microphones and, for example, on requirements regarding the directional diagram $\Psi(\omega,\Theta)$. The relative error $\Delta^2(\omega,\Theta)$, in general, is the sum of the mean square error of the transfer properties of all microphones $\epsilon^2(\omega,\Theta)$ and the Gaussian error with zero mean of the microphone positions $\delta^2(\omega)$.

Defective array parameters may also disturb the ideal directional diagram; the corresponding error can be given by $\Delta^2(\omega,\Theta)K(\omega)$. If one requires that the deviations in the directional diagram do not exceed an upper bound of $\Delta\Psi_{max}(\omega,\Theta)$, one obtains for the maximum susceptibility:

$$K_{\max}(\omega, \Theta) = \frac{\Delta\Psi_{\max}(\omega, \Theta)}{\varepsilon^2(\omega, \Theta) + \delta^2(\omega)}$$

It is to be noted that in many cases the dependence on the angle $\Theta$ can be neglected.

In practice, the error in the microphone transfer functions $\epsilon(\omega)$ has a higher influence on the maximum susceptibility $K_{max}(\omega)$ and, thus, also on the maximum possible gain $G(\omega)$ than the error $\delta^2(\omega)$ in the microphone positions. In other words, the defective transfer functions are mainly responsible for the limitation of the maximum susceptibility.

A higher mechanical precision to reduce the position deviations of the microphones is only sensible up to a certain point since the microphones usually are modeled as being point-like, which is not true in reality. Thus, one can fix the positioning errors $\delta^2(\omega)$ to a specific value, even if a higher mechanical precision could be achieved. For example, one can take $\delta^2(\omega)=1\%$ which is quite realistic. The error $\epsilon(\omega)$ can be derived from the frequency depending deviations of the microphone transfer functions.

To compensate the above-mentioned errors, inverse filters can be used to adjust the individual microphone transfer functions to a reference transfer function. Such a reference transfer function can be the transfer function of one microphone out of the array or, for example, the mean of all measured transfer functions. In case of the first possibility, only M−1 inverse filters (M being the number of microphones) are to be computed and implemented.

In general, the transfer functions are not minimal phase, thus, a direct inversion would yield instable filters. Usually, one inverts only the minimum phase part of the transfer function (resulting in a phase error) or one inverts the ideal (non-minimum phase) filter only approximately. In the following, the approximate inversion with the help of an FXLMS (filtered X least mean square) or the FXNLMS (filtered X normalized least mean square) algorithm will be described.

After computing of the inverse filters, they can be coupled with the superdirective filters $A_i(\omega)$ such that, in the end, only one filter per viewing direction and microphone is to be implemented.

Figure 2:
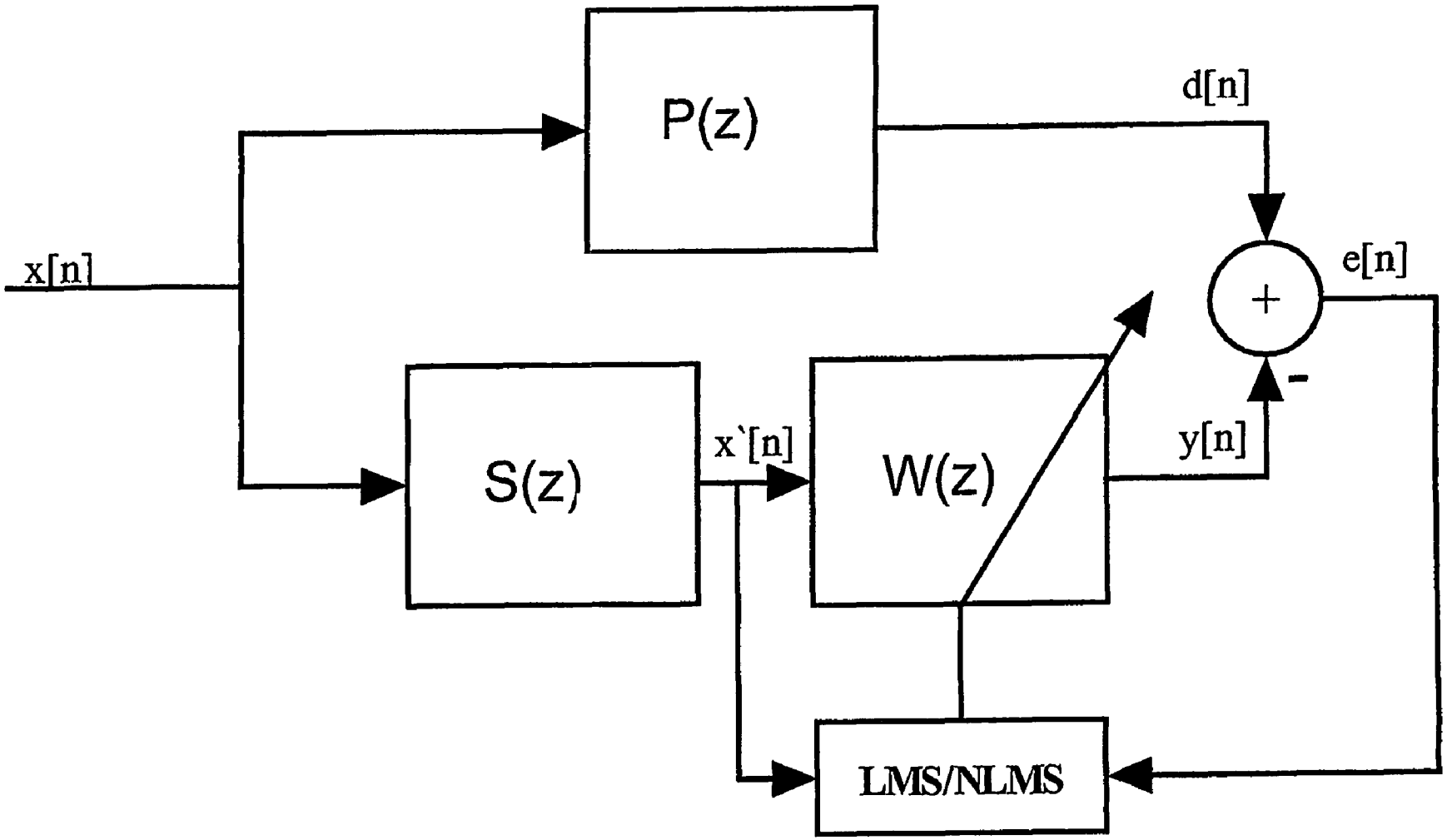
FIG. 2 illustrates an FXLMS algorithm.

The FXLMS or the FXNLMS algorithm is described with reference to FIG. 2. The error signal e[n] at time n is calculated according to $$\begin{aligned} e[n] &= d[n] - y[n] \\ &= (p^T[n]x[n]) - (w^T[n]x'[n]) \\ &= (p^T[n]x[n]) - (w^T(s^T[n]x[n])) \end{aligned}$$

with the input signal vector $$x[n]=[x[n], x[n-1], \ldots, x[n-L+1]]^T$$

wherein L denotes the filter length of the inverse filter W(z). The filter coefficient vector of the inverse filter has the form $$w[n]=[w_0[n], w_1[n], \ldots, w_{L-1}[n]]^T,$$

the filter coefficient vector of the reference transfer function P(z)

$$p[n]=[p_0[n], p_1[n], \ldots, p_{L-1}[n]]^T$$

and the filter coefficient vector of the n-th microphone transfer function S(z)

$$s[n]=[s_0[n], s_1[n], \ldots, s_{L-1}[n]]^T.$$

The update of the filter coefficients of w[n] is performed iteratively, i.e. at each time step n, whereby the filter coefficient w[n] are computed such that the instantaneous squared error $e^2[n]$ is minimized. This can be achieved, for example, by using the LMS algorithm:

$$w[n+1]=w[n]+\mu x'[n]e[n]$$

or by using the NLMS algorithm $$w[n+1] = w[n] + \frac{\mu}{x'[n]^T x'[n]} x'[n]e[n]$$

wherein μ characterizes the adaption steps and $$x'[n]=[x'[n], x'[n-1], \ldots, x'[n-L+1]]^T$$

denotes the input signal vector filtered by S(z).

In general, the susceptibility increases with decreasing frequency. Thus, it is preferred to adjust the microphone transfer functions depending on frequency, in particular, with a high precision for low frequencies. To achieve a high precision of the inverse filters, the FIR filters, for example, are to be very long in order to obtain a sufficient frequency resolution in the desired frequency range. This means that the expenditure, in particular, regarding the memory, increases rapidly. When using a reduced sampling frequency of, for example, $f_a$=8 kHz, the computing time does not impose a severe limitation. A suitable frequency depending adaption of the transfer functions can be achieved by using short WFIR filters (warped filters).

One possible iterative method to design the filters $A_i(\omega)$ with predetermined susceptibility goes as follows:

1. Set $\mu(\omega)=1$.
2. Determine the transfer functions of the filters $A_i(\omega)$ and the resulting susceptibilities $K(\omega)$ according to the equations:

$$A_i(\omega) = \frac{(\Gamma(\omega)+\mu I)^{-1} d}{d^T(\Gamma(\omega)+\mu I)^{-1} d}$$

and $$K(\omega) = \frac{1}{WNG(\omega)} = \frac{A(\omega)^H A(\omega)}{|A(\omega)^H d(\omega)|}.$$

3. If the susceptibility $K(\omega)$ is larger than the maximum susceptibility ($K(\omega)>(K_{max}(\omega))$), increase μ in the following step, otherwise, decrease μ.
4. Repeat steps 2 and 3 until the susceptibility $K(\omega)$ is sufficiently close to the predetermined value $K_{max}(\omega)$. The iteration is to break off if μ becomes smaller than a lower limit of, for example, $\mu_{min}=10^{-8}$. Such a termination criterion is mainly necessary for high frequencies $f \geqq c/(2d_{mic})$.

Of course, there are other possibilities to compute the filters $A_i(\omega)$. For example, one can use a fixed parameter μ for all frequencies. This simplifies the computation of the filter coefficients. It is to be noted that the above iterative method is not used for a real time adaption of the filter coefficients during operation.

A realization of the beamforming filters in the time domain is described with reference to FIG. 3. Again, signals are recorded by microphones 1. A near field beamsteering 5 is performed using gain factors $v_k$ 51 to compensate for the amplitude differences and time delays $\tau_k$ 52 to compensate for the transit time differences of the microphone signals $x_k[i]$. The realization of the superdirective beamforming is achieved using the filters (preferably, FIR filters) $a_k(i)$ indicated by reference sign 6.

The impulse responses $a_1(i), \ldots, a_M(i)$ can be determined as follows:

1. Determine the frequency responses $A_i(\omega)$ according to the above equation.
2. To obtain real valued impulse responses $a_1(i), \ldots, a_M(i)$, chose the frequency responses above half of the sampling frequency to ($A_i(\omega)=A^*_i(\omega_A-\omega)$) with $\omega_A$ denoting the sampling angular frequency.
3. Transfer these frequency responses to the time domain using an IFFT yielding the desired FIR filter coefficients $a_1(i), \ldots, a_M(i)$.
4. Applying a window function, for example, a Hamming window, to the FIR filter coefficients $a_1(i), \ldots, a_M(i)$.

Figure 3:
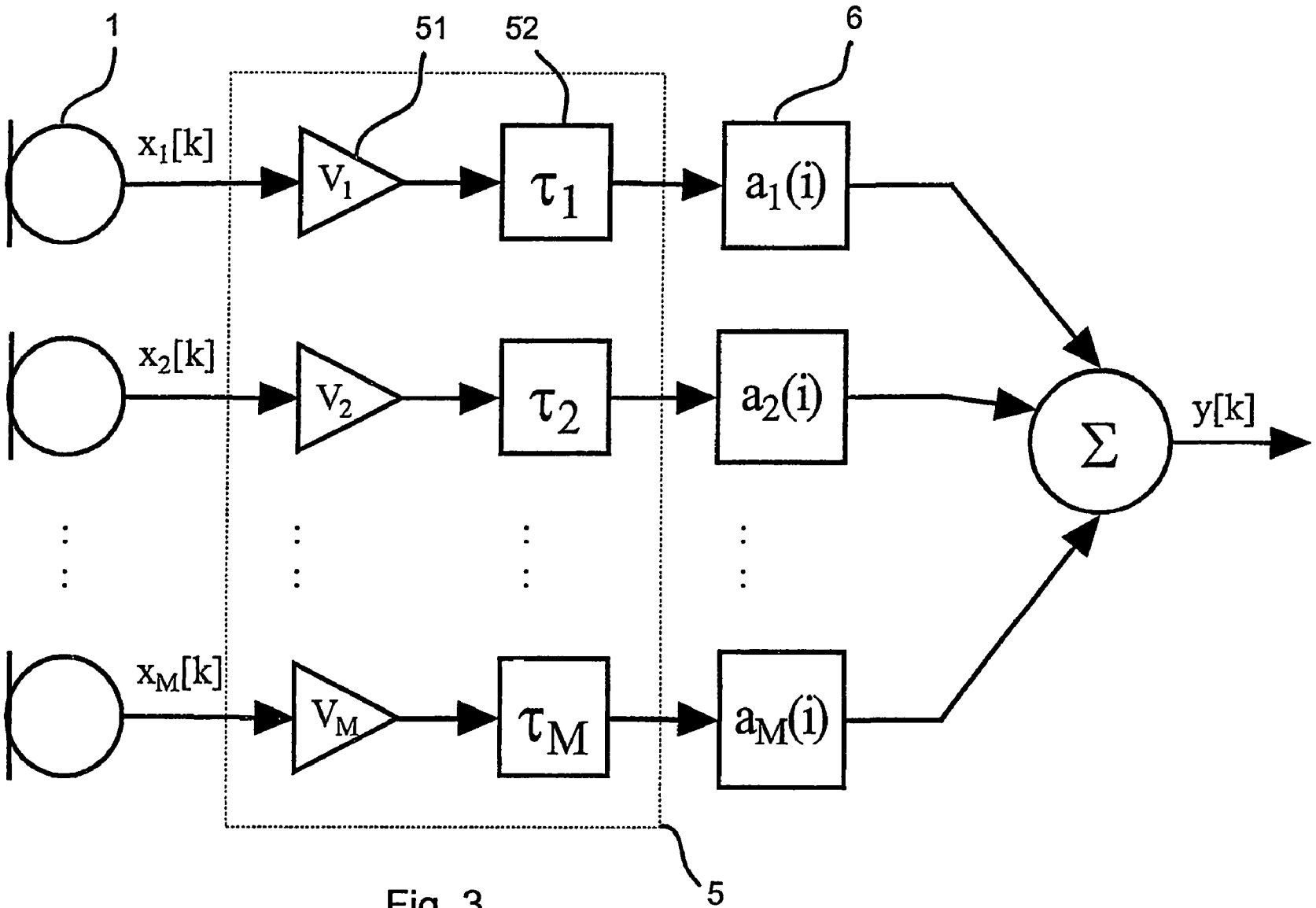
FIG. 3 shows a realization of beamforming filters in the time domain.

As can be seen in FIG. 3, in contrast to the beamforming in the frequency domain as described above, the microphone signals are directly processed using the beamsteering 5 in the time domain. The beamsteering 5 is followed by the FIR filtering 6. After summing the filtered signals, a resulting enhanced signal y[k] is obtained.

Depending on the distance between speaker and microphone array, on the distance between the microphones themselves, and on the sampling frequency $f_a$, more or less propagation or transit time between the microphone signals is to be compensated. The following equation is to be taken into account:

$$\Delta_{max} = \frac{d_{mic} f_a}{c}.$$

The higher the sampling frequency $f_a$ or the higher the distance between adjacent microphones, the more transit time $\Delta_{max}$ (in taps of delay) is to be compensated for. The number of taps increases also if the distance between speaker and microphone arrays is decreased. In the near field, more transit time is to be compensated for than in the far field. It turns out that an array in endfire orientation is less sensitive to a defective transit time compensation $\Delta_{max}$ than an array in broadside orientation.

In a vehicle, the average distance between the speaker, in particular, its head, and the array is about 50 cm. Due to a movement of the head, this distance can change of about +/−20 cm. If a transit time error of 1 tap is acceptable, the distance between the microphones in broad-side orientation with a sampling frequency of $f_a$=8 kHz should be smaller than about $d_{mic_max}$ (broad-side)≅5 cm. With the same conditions, the maximum distance between the microphones in endfire orientation can be about $d_{mic_max}$ (endfire)≅20 cm.

On the other hand, having a distance between the microphones of about 5 cm, it turns out that a sampling frequency of $f_a$=16 kHz provides excellent results for an endfire orientation whereas in broad-side orientation, only a sampling frequency of $f_a$=8 kHz can be used without adaptive beamsteering. In other words, in endfire orientation, the sampling frequency or the distance between the microphones can be chosen much higher than in the broad-side case, thus, resulting in an improved beamforming.

In this context, it is to be pointed out that the larger the distance between the microphones, the sharper the beam, in particular, for low frequencies. A sharper beam at low frequencies increases the gain in this range which is important for vehicles where the noise is mostly a low frequency noise.

However, the larger the microphone distance, the smaller the usable frequency range according to the spatial sampling theorem $$f \leq \frac{c}{2d_{mic}}.$$

A violation of this sampling theorem has the consequence that at higher frequencies, large grating lobes appear. These grating lobes, however, are very narrow and deteriorate the gain only slightly. The maximum microphone distance that can be chosen depends not only on the lower limiting frequency for the optimization of the directional characteristic, but also on the number of microphones and on the distance of the microphone array to the speaker. In general, the larger the number of microphones, the smaller their maximum distance in order to optimize the Signal-To-Noise-Ratio (SNR). For a distance between array and speaker of 50 cm, the microphone distance, preferably, is about $d_{mic}$=40 cm with two microphones (M=2) and about $d_{mic}$=20 cm for M=4.

A further improvement of the directivity, and, thus, of the gain, can be achieved by using unidirectional microphones instead of omnidirectional ones; this will be discussed in more detail below.

Figure 4A:
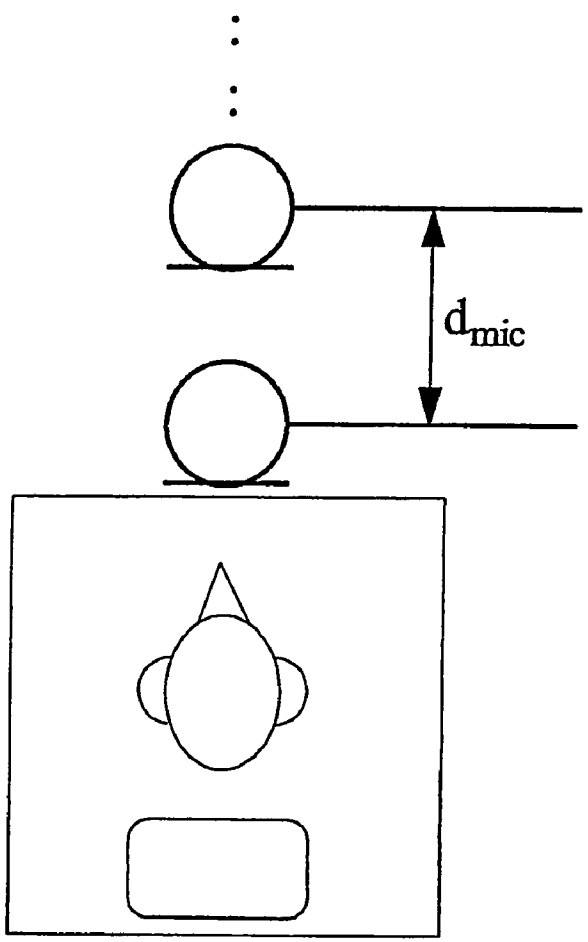
FIG. 4A illustrates a preferred embodiment of arrangements of a microphone array in a vehicle.
Figure 4A:
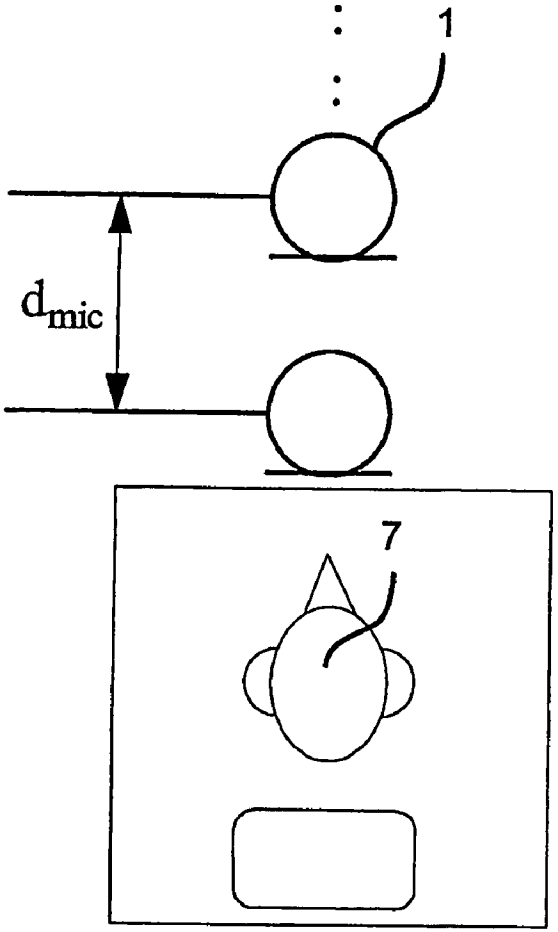
Figure 4B:
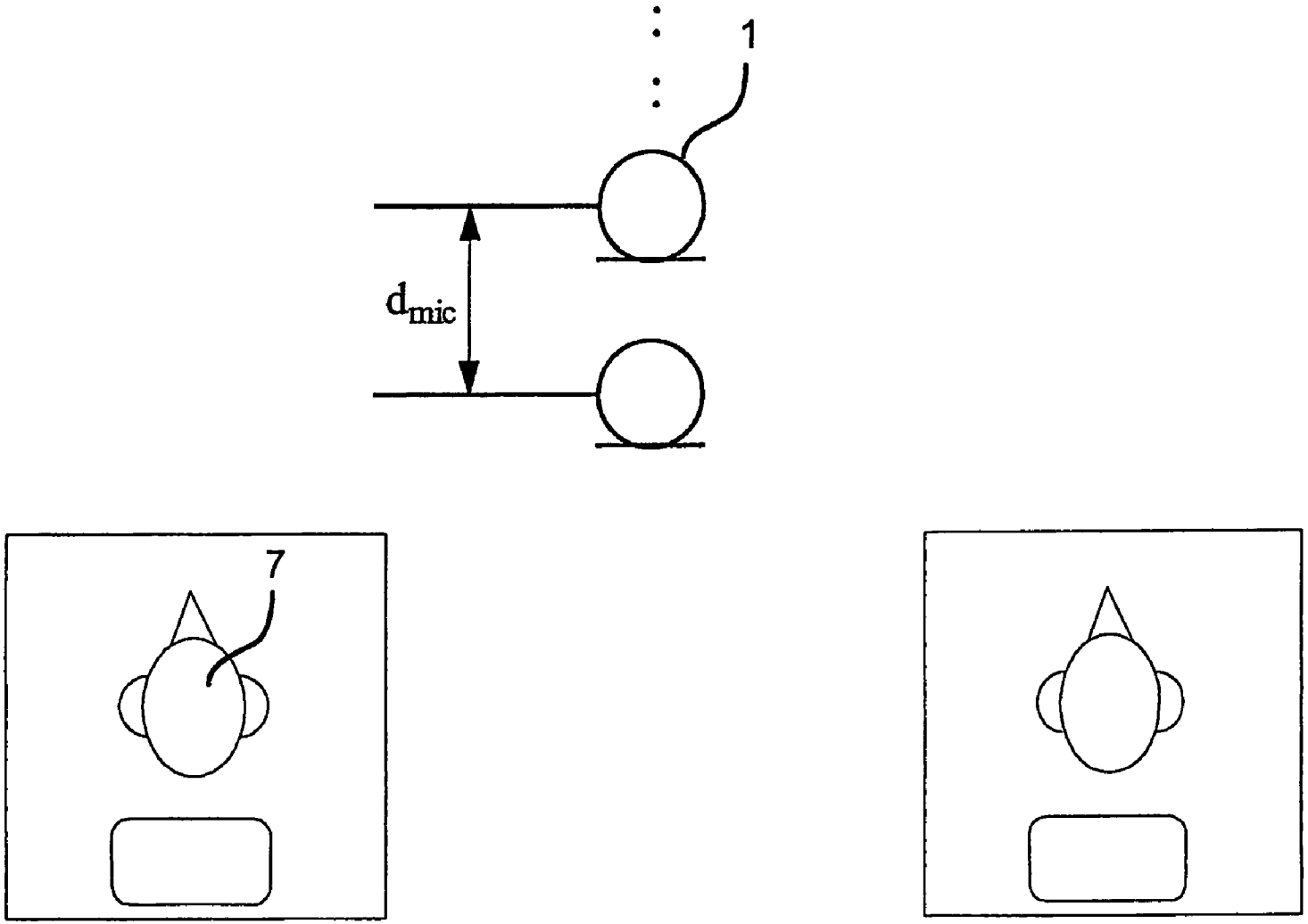
FIG. 4B illustrates another preferred embodiment of an arrangement of a microphone array in a vehicle.

FIGS. 4A and 4B show preferred arrangements of microphone arrays in a vehicle. In general, the distance between the microphone array and the speaker should be as small as possible.

According to a first embodiment (FIG. 4A), each speaker 7 can have its own microphone array comprising at least two microphones 1. The microphone arrays can be provided at different locations, for example, within the headliner, dashboard, pillar, headrest, steering wheel, compartment door, visor or (driving) mirror. An arrangement within the roof is also a preferred possibility that is, however, not suitable for the case of a cabriolet. Both microphone arrays for each speaker are in endfire orientation.

In an alternative embodiment (FIG. 4B), one microphone array is used for two neighboring speakers. In both embodiments, preferably, directional microphones, in particular, having a cardioid characteristic, can be used.

In the embodiment of FIG. 4B, the microphone array can be mounted within the mirror. Such a linear microphone array can be used for both the driver and the front seat passenger. A costly mounting of the microphones in the roof can be avoided. Furthermore, the array can be mounted in one piece, which ensures a high mechanical precision. Due to the adjustment of the mirror, the array would always be correctly oriented.

Figure 5A:
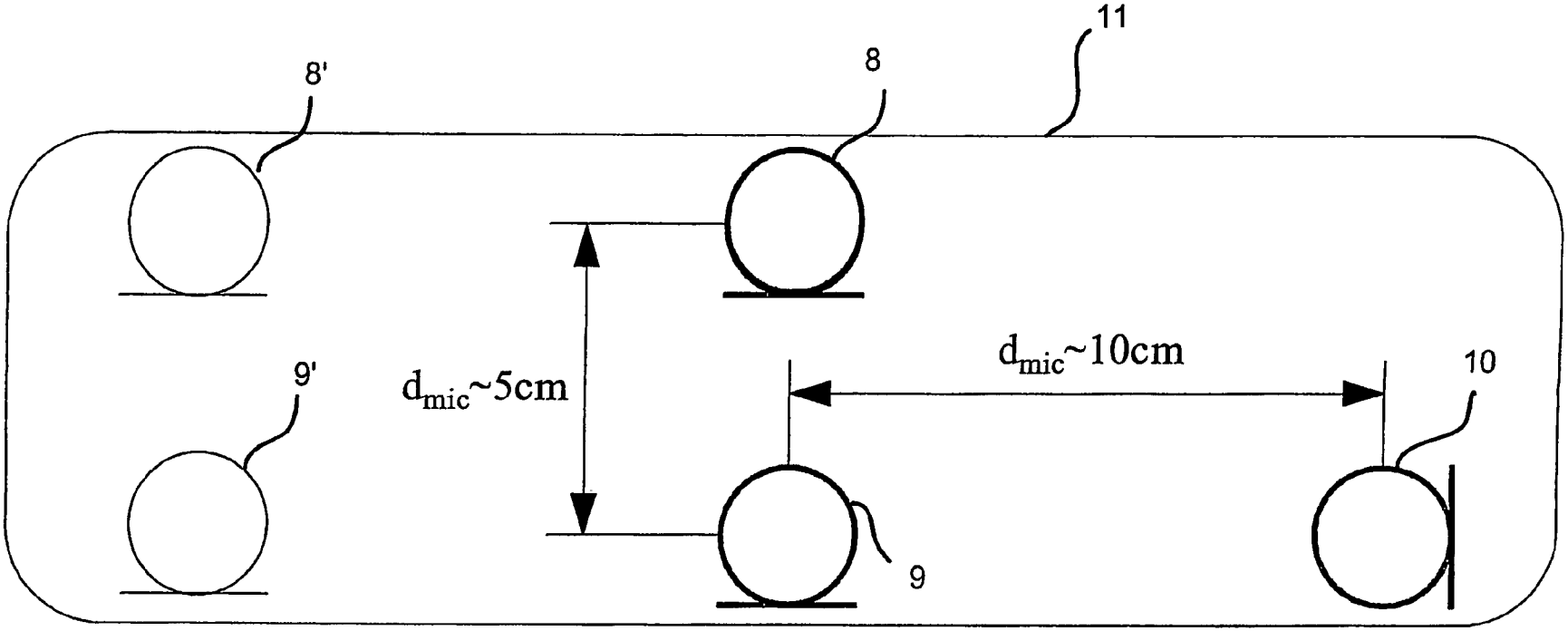
FIG. 5A illustrates a preferred embodiment of an arrangement of a microphone array in a mirror.

FIG. 5A shows a top view on a (driving) mirror 11 of a car with three microphones in two alternative arrangements. According to the first alternative, two microphones 8 and 9 are located in the center of the mirror in endfire orientation with respect to the driver and, preferably, have a distance of about 5 cm between each other. The microphones 9 and 10 are in endfire orientation with respect to the front seat passenger and have a distance of about 10 cm between each other.

Since the microphone 9 is used for both arrays, a cheap handsfree system can be provided.

All three microphones can be directional microphones, preferably having a cardioid characteristic, for example, a hypercardioid characteristic. Alternatively, microphones 8 and 10 are directional microphones, whereas microphone 9 is an omnidirectional microphone which further reduces the costs. If all three microphones are directional microphones, preferably, microphones 8 and 9 are directed towards the driver.

Due to the larger distance between microphones 9 and 10 than between microphones 8 and 9, the front seat passenger beamformer has a better SNR at low frequencies.

According to an alternative embodiment, the microphone array for the driver consists of microphones 8' and 9' located at the left side of the mirror. In this case, the distance between this microphone array and the driver would be increased, thus, decreasing the performance. On the other hand, the distance between microphone 9' and 10 would be about 20 cm, which yields a better gain for the front seat passenger at low frequencies.

Figure 5B:
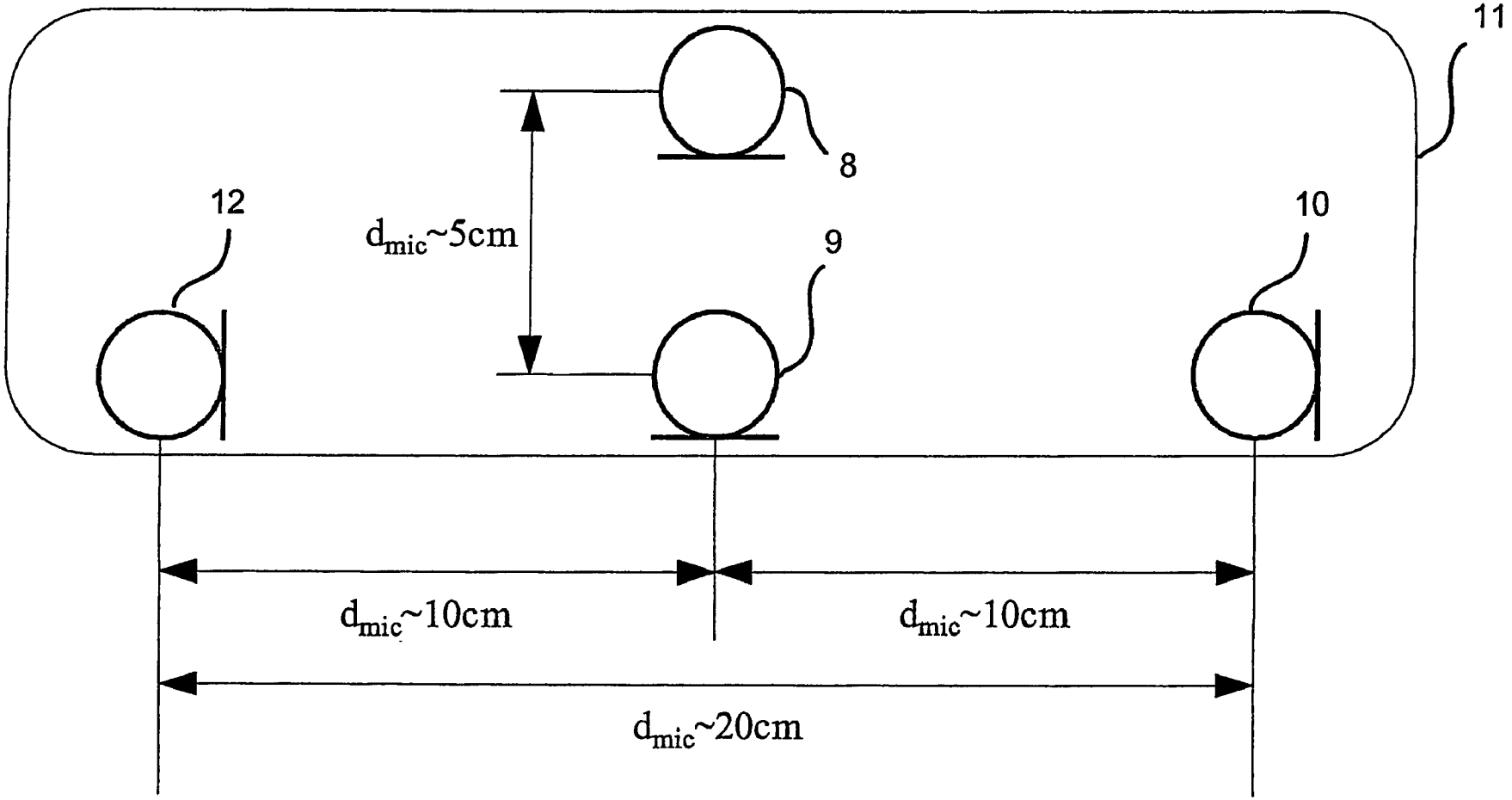
FIG. 5B illustrates another preferred embodiment of an arrangement of a microphone array in a mirror.

A variant of two microphone arrays with improved precision is shown in FIG. 5B. Also in this case, all microphones can be directional microphones, microphones 8 and 9 being directed to the driver, microphones 10 and 12 being directed to a front seat passenger. In this example, the microphone array for the front seat passenger comprises the three microphones 9, 10 and 12, which increases the gain considerably.

It is to be noted that these arrangements are only examples that can be varied by changing the position and number of the microphones. In particular, an arrangement can be optimized with regard to a specific vehicular cabin.

Figure 6:
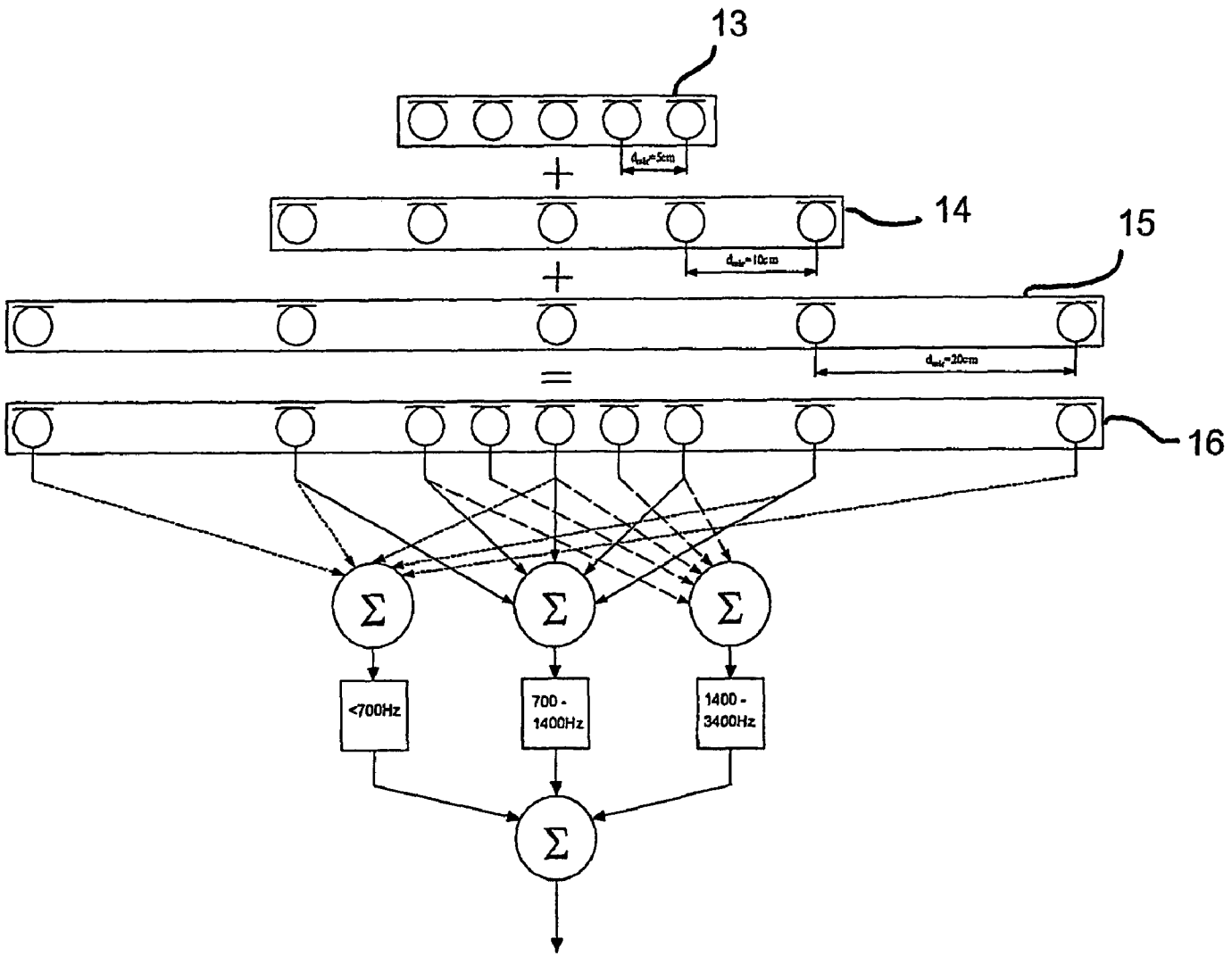
FIG. 6 shows a microphone array consisting of three subarrays.

FIG. 6 illustrates a microphone array comprising three subarrays 13, 14, and 15, each subarray consisting of five microphones. Within each subarray 13, 14, and 15, the microphones are equidistantly arranged. In the total array 16, the distances are no longer equal. As can be seen in this figure, some microphones are used for different arrays, therefore, for the total array, only 9 microphones and not 3·5=15 microphones are necessary.

In this figure, it is further indicated that the different subarrays are used for different frequency ranges. The resulting directional diagram is then built up of the directional diagrams of each subarray for the respective frequency range. For the special case of FIG. 6, subarray 13 with $d_{mic}$=5 cm is used for the frequency band of 1400-3400 Hz, subarray 14 with $d_{mic}$=10 cm with for the frequency band of 700-1400 Hz, and subarray 15 with $d_{mic}$=20 cm for the band of frequencies smaller than 700 Hz. A lower limit of this frequency band can be imposed, for example, by the lowest frequency of the telephone band (the frequencies used in telephone applications) which, presently, is 300 Hz in most cases.

Figure 7:
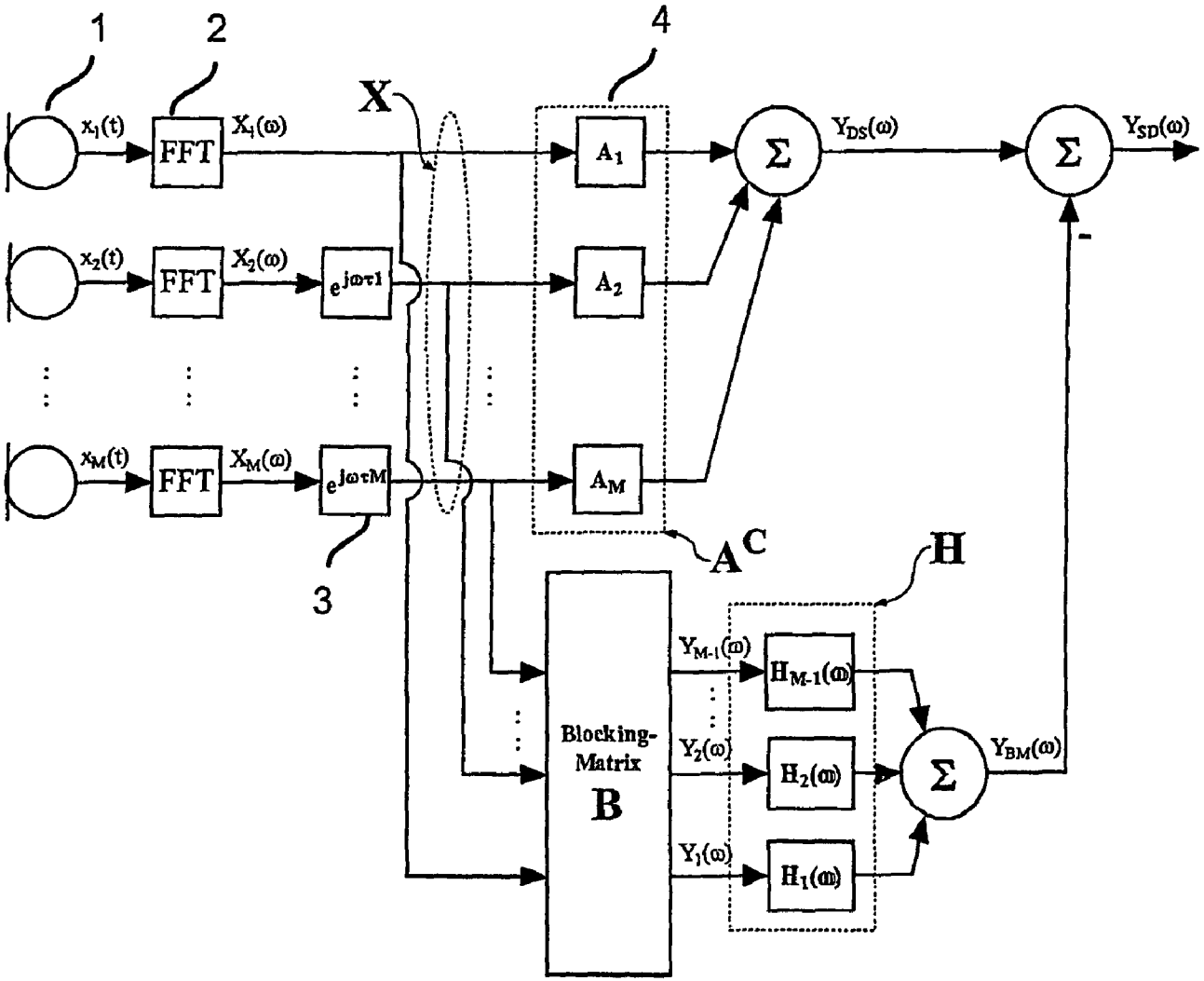
FIG. 7 illustrates a superdirective beamformer in GSC structure.

An improved directional characteristic can be obtained if the superdirective beamformer is designed as general side lobe canceller (GSC). In this structure, at least one filter can be saved. Such a superdirective beamformer in GSC structure is shown in FIG. 7. The GSC structure is to be implemented in the frequency domain, thus, an FFT 3 is applied to the incoming signals $x_k(t)$. Before the general sidelobe cancelling, a time alignment using phase factors $e^{j\omega\tau_k}$ has to be performed (in this figure, a far field beamsteering is shown).

In FIG. 7, X denotes a vector comprising all time aligned input signals $X_i(\omega)$. $A^C$ is a vector comprising all frequency independent filter transfer functions $A_i$ that are necessary to observe the constraints in viewing direction; H is the vector of the transfer functions performing the actual superdirectivity; and B is the so-called blocking matrix projecting the input signals in X onto the "noise plane". The signal $Y_{DS}(\omega)$ denotes the output signal of the delay and sum beamformer, $Y_{BM}(\omega)$ the resulting output signal of the blocking branch, $Y_{SD}(\omega)$ the output signal of the superdirective beamformer $x_i(t)$ and $X_i(\omega)$ the input signals in the time and frequency domain that are not yet time aligned, and $Y_i(\omega)$ the output signals of the blocking matrix that ideally should block completely the desired or useful signal within the input signals. The signals $Y_i(\omega)$ ideally only comprise the noise signals.

In addition to the superdirective output signal, a GSC structure also yields a delay and sum beamformer signal and a blocking output signal. The number of filters that can be saved using the GSC, depends on the choice of the blocking matrix. Usually, a Walsh-Hadamard blocking matrix is preferred instead of a Griffiths-Jim blocking matrix since more filters can be saved with a Walsh-Hadamard blocking matrix. Unfortunately, the Walsh-Hadamard blocking matrix can only be given for arrays consisting of $M=2^n$ microphones.

In principle, a blocking matrix should have the following properties:

1. It is a $(M-1)\cdot M$–Matrix.
2. The sum of the values within one row vanishes.
3. The matrix is of rank $M-1$.

A Walsh-Hadamard blocking matrix for n=2 has the following form $$B = \begin{bmatrix} 1 & 1 & -1 & -1 \\ 1 & -1 & -1 & 1 \\ 1 & -1 & 1 & -1 \end{bmatrix}.$$

According to an alternative embodiment, a blocking matrix according to Griffiths-Jim can be used which has the general form $$B = \begin{bmatrix} 1 & -1 & 0 & \cdots & 0 \\ 0 & 1 & -1 & \cdots & 0 \\ \vdots & & \ddots & \ddots & \vdots \\ 0 & 0 & \cdots & 1 & -1 \end{bmatrix}.$$

The upper branch of the GSC structure is a delay and sum beamformer with the transfer functions $$A^C = \left[\underbrace{\frac{1}{M}, \frac{1}{M}, \ldots, \frac{1}{M}}_{M}\right]^T.$$

The computation of the filter coefficients of a superdirective beamformer in GSC structure is slightly different compared to the conventional superdirective beamformer. The transfer functions $H_i(\omega)$ are to be computed as $$H_i(\omega)=(B\Phi_{NN}(\omega)B^H)^{-1}(B\Phi_{NN}(\omega)A^C),$$

wherein B is the blocking matrix and $\Phi_{NN}(\omega)$ the matrix of the cross-correlation power spectrum of the noise. In the case of a homogenous noise field, $\Phi_{NN}(\omega)$ can be replaced by the time aligned coherence matrix of the diffuse noise field $\Gamma(\omega)$, as previously discussed.

A regularization and the iterative design with predetermined susceptibility can be performed in the same way as above.

Figure 8:
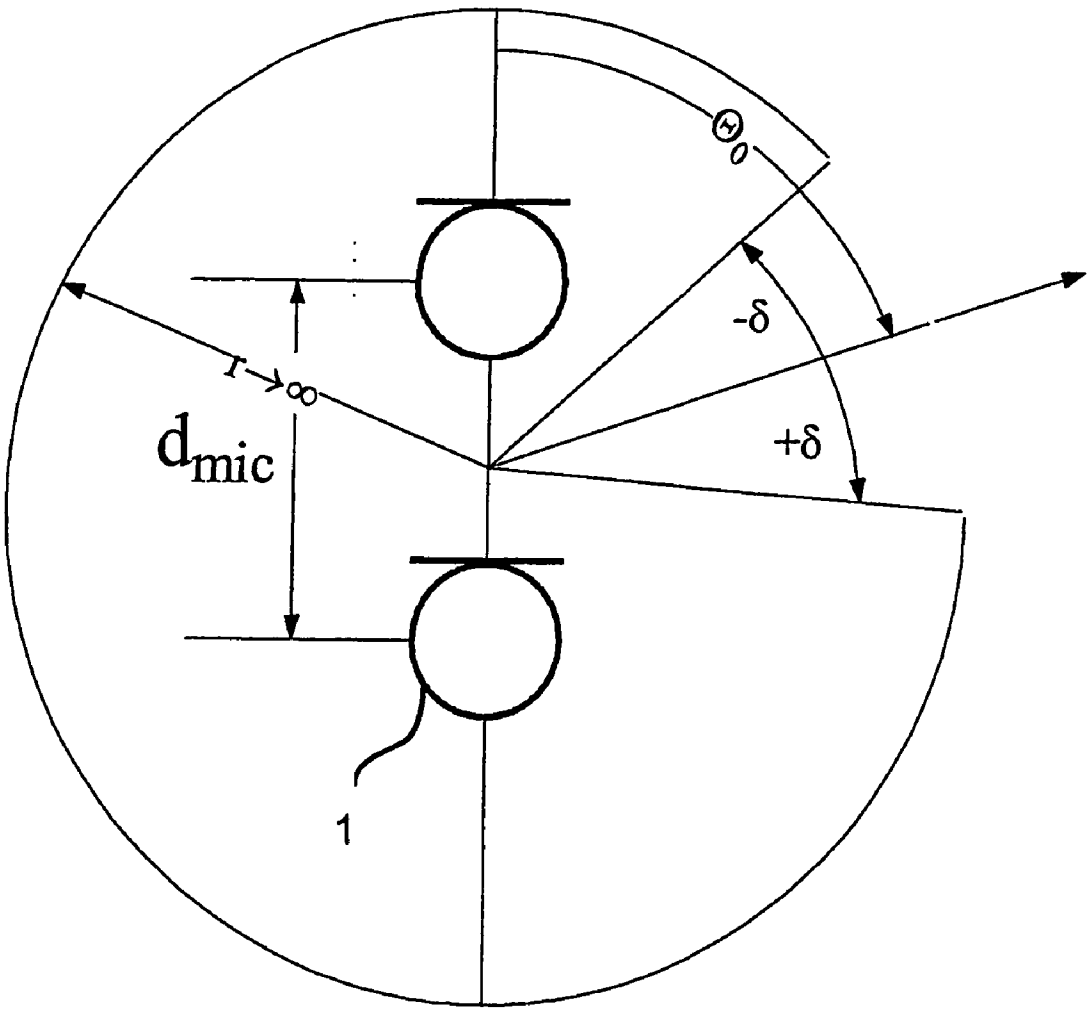
FIG. 8 illustrates a microphone array with two microphones in a noise field with a noise-free sector.

All previously discussed filter designs only assume that the noise field is homogenous and diffuse. These designs can be generalized by excluding a region around the main receiving direction $\Theta_0$ when determining the homogenous noise field. In this way, mainly the Front-To-Back-Ratio can be optimized. This is illustrated in FIG. 8 where a sector of +/−δ is excluded. The computing of the two-dimensional diffuse (cylindrically isotropic), homogenous noise field can be performed using the new design parameter δ:

$$\Gamma(\omega, \Theta_0, \delta) = \frac{1}{2(\pi-\delta)}\int_{\Theta_0+\delta}^{\Theta_0-\delta+2\pi} e^{j\left(\frac{2\pi f d_{ij}\cos\Theta}{c}\right)} d\Theta e^{-j\left(\frac{2\pi f d_{ij}\cos\Theta_0}{c}\right)},$$

$$i, j \in [1, \ldots, M]$$

This method can also be generalized to the three-dimensional case. Then, in addition to the parameter δ being responsible for the azimuth, a further parameter ρ is to be introduced for the elevation angle. This yields an analog equation for the coherence of the homogeneous diffuse 3D noise field.

A superdirective beamformer based on an isotropic noise field is particularly useful for a handsfree system which is to be installed later in a vehicle. This is the case, for example, if the handsfree system is installed in the vehicle by the user itself. On the other hand, an MVDR beamformer can be relevant if there are specific noise sources at fixed relative positions or directions with respect to the position of the microphone array. In this case, the handsfree system can be adapted to a particular vehicular cabin by adjusting the beamformer such that its zeros point into the direction of specific noise sources. For example, such a noise source can be formed by a loudspeaker or a fan. Preferably, a handsfree system with MVDR beamformer is already installed during manufacture of the vehicle.

The typical distribution of noise or noise sources in a particular vehicular cabin can be determined by performing corresponding noise measurements under appropriate conditions (e.g., driving noise with and/or without loudspeaker and/or fan noise). The measured data are used for the design of the beamformer. It is to be noted that also in this case, no further adaption is performed during operation of the handsfree system.

Alternatively, if the relative position of a noise source is known, the corresponding superdirective filter coefficients can also be determined theoretically.

Figure 9:
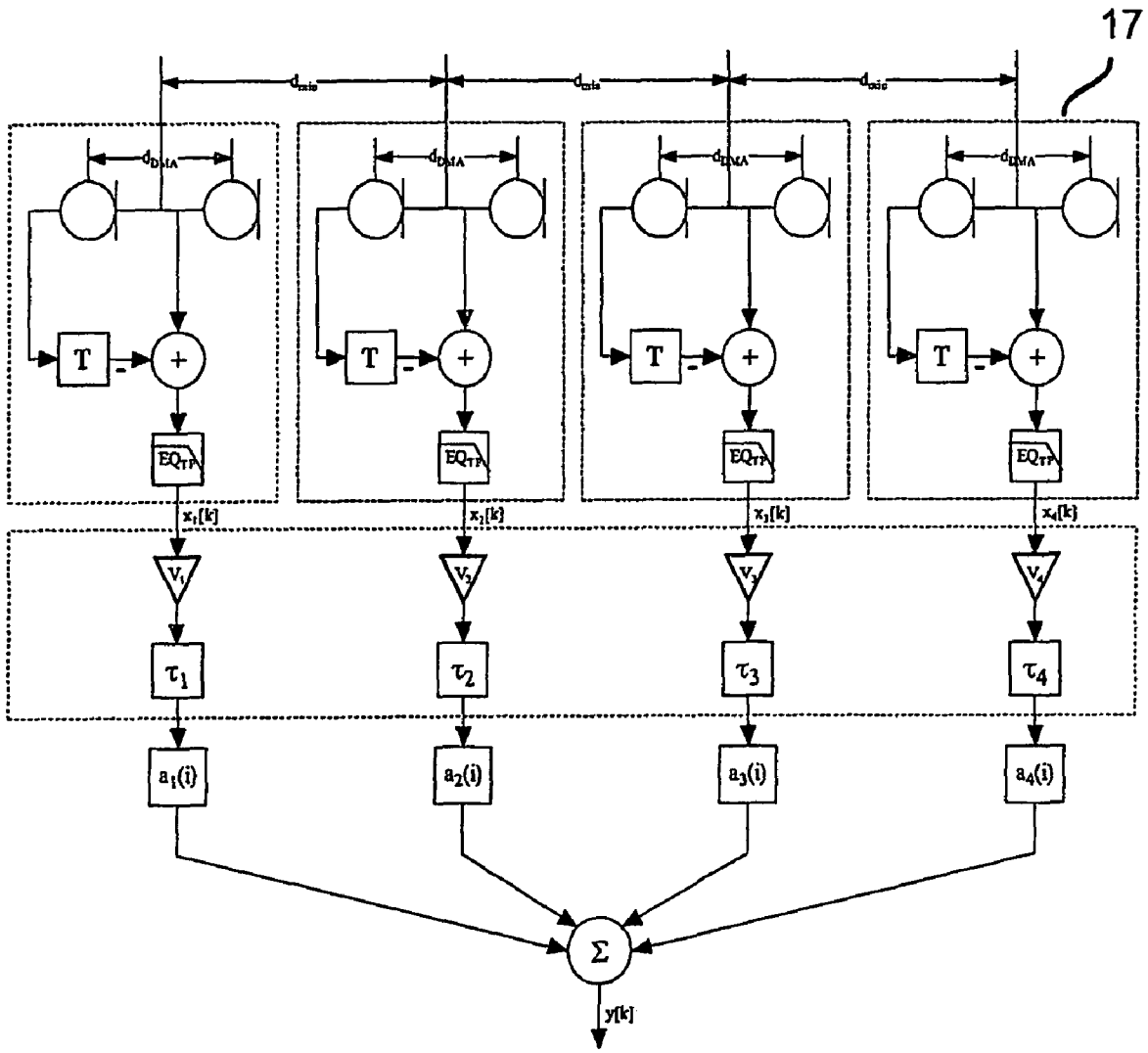
FIG. 9 shows a superdirective beamformer comprising four first order gradient microphones.

As already stated above, the use of directional microphones further improves the signal enhancement. FIG. 9 shows a superdirective beamformer with directional microphones 17. In this figure, each directional microphone 17 is depicted by its equivalent circuit diagram. In these circuit diagrams, $d_{DMA}$ denotes the (virtual) distance of the two omnidirectional microphones composing the first order pressure gradient microphone in the circuit diagram. T is the (acoustic) delay line fixing the characteristic of the directional microphone and $EQ_{TP}$ is the equalizing low path filter yielding a frequency independent transfer behavior in viewing direction.

In practice, these circuits and filters can be realized purely mechanically by taking an appropriate mechanical directional microphone. Again, the distance between the directional microphones is $d_{mic}$. In FIG. 9, the whole beamforming is performed in the time domain. A near field beamsteering is applied to the signals $x_n[i]$ coming from the microphones and being filtered by the equalizing filter $EQ_{TP}$. The gain factors $v_n$ compensate for the amplitude differences and the delays $\tau_n$ for the transit time differences of the signals. The FIR filters $a_n[i]$ realize the superdirectivity in the time domain.

Mechanical pressure gradient microphones have a high quality and yield, in particular, using a hypercardioid characteristic, an excellent array gain. The use of directional microphones results in an excellent Front-to-Back-Ratio as well.

All previously discussed embodiments are not intended as limitations but serve as examples illustrating features and advantages of the invention. It is to be understood that some or all of the above described features can also be combined in different ways.

The invention claimed is:

1. A system for use in a vehicle comprising:

a microphone array with at least two microphones; and a superdirective beamformer with fixed superdirective filters;

where the superdirective beamformer is a regularized superdirective beamformer using a finite regularization parameter $\mu$ that is frequency dependent.

2. A system according to claim 1 where each superdirective filter results from an iterative design based on a predetermined maximum susceptibility.

3. A system according to claim 1 where each superdirective filter comprises a filter in the time domain.

4. A system according to claim 1 where the signal processing means further comprises at least one inverse filter for adjusting a microphone transfer function.

5. A system according to claim 4 where the at least one inverse filter comprises a warped inverse filter.

6. A system according to claim 4 where each inverse filter comprises an approximate inverse of a non-minimum phase filter.

7. A system according to claim 4 where each inverse filter is combined with a superdirective filter of the beamformer.

8. A system according to claim 1 where the beamformer comprises the structure of a generalized sidelobe canceller (GSC).

9. A system according to claim 1 where the beamformer comprises a minimum variance distortionless response (MVDR) beamformer.

10. A system according to claim 1 where the microphone array comprises at least two microphones arranged in an endfire orientation with respect to a first position.

11. A system according to claim 10 where the microphone array comprises at least two microphones arranged in endfire orientation with respect to a second position.

12. A system according to claim 11 where the at least two microphones in the first endfire orientation and the at least two microphones in the second endfire orientation comprise a microphone in common.

13. A system according to claim 1 where the microphone array comprises at least two subarrays.

14. A system according to claim 13 where the at least two subarrays comprise at least one microphone in common.

15. A system according to claim 1 further comprising a frame where each microphone of the microphone array is arranged in a predetermined position in or on the frame.

16. A system according to claim 15 where the predetermined position comprises a fixed position in or on the frame.

17. A system according to claim 1 where at least one microphone comprises a directional microphone.

18. A system according to claim 17 where the directional microphone comprises a directional microphone with a cardioid characteristic.

19. A system according to claim 17 where the directional microphone comprises a differential microphone.

20. A system according to claim 1 comprising a vehicle coupled to the microphone and the beamformer.

21. A system for use in a vehicle comprising:

a microphone array with at least two microphones and a superdirective beamformer having fixed superdirective filters;

where the superdirective beamformers are configured with a predetermined susceptibility that is based on a relative error of the microphone array;

where the relative error of the microphone array is a sum of mean square error of transfer properties of each microphone in the microphone array and a gaussian error with zero mean of microphone positions.

22. A system according to claim 21 where at least two microphones in the microphone array are arranged in an endfire orientation with respect to a first position.

23. A system according to claim 22 where at least two microphones in the microphone array are arranged in an endfire orientation with respect to a second position.

24. A system according to claim 21 where at least one microphone comprises a directional microphone.

25. A system according to claim 24 where the directional microphone comprises a directional microphone with a cardio characteristic.

26. A system according to claim 24 where the directional microphone comprises a differential microphone.

* * * * *